US005207165A

United States Patent [19]

Gazzarrini

[11] Patent Number: 5,207,165

[45] Date of Patent: May 4, 1993

[54] METHOD FOR VARYING THE CURVATURE OF THE SEWN TIP OF STOCKINGS WITH A SEWING MACHINE AND DEVICE FOR CARRYING OUT SAID METHOD

[75] Inventor: Vinicio Gazzarrini, Impruneta, Italy

[73] Assignee: Solis S.r.l., Florence, Italy

[21] Appl. No.: 842,064

[22] Filed: Feb. 26, 1992

[30] Foreign Application Priority Data

Feb. 26, 1991 [IT] Italy ..... 000039 A/91

[51] Int. Cl.[5] ..... D05B 21/00

[52] U.S. Cl. ..... 112/262.2; 112/262.3; 112/121.15

[58] Field of Search ..... 112/262.2, 262.3, 121.15, 112/121.12; 223/112, 43, 75

[56] References Cited

U.S. PATENT DOCUMENTS

| | | | |
|---|---|---|---|
| 4,444,140 | 4/1984 | Moyer | 112/121.15 X |
| 4,903,621 | 2/1990 | Hodges et al. | 112/121.15 |
| 5,014,634 | 5/1991 | Hodges et al. | 112/262.2 |
| 5,040,475 | 8/1991 | Fournier et al. | 112/121.15 |

*Primary Examiner*—Peter Nerbun

*Attorney, Agent, or Firm*—McGlew and Tuttle

[57] ABSTRACT

A method and device are provided to change the curvature of the seam of the tip of stockings wherein a sewing machine is utilized in correspondence with a rotating, circular, horizontal plane for supporting the flattened tip of the stocking to be sewn with a suspended coaxial plate with alternating vertical motion and jointly rotating for holding the tip of the stocking steady during the sewing. A device is disclosed for gripping in several points, separately, the free end of the flattened tip of the stocking to be sewn which projects beyond the rotating sewing plane (4). A pneumatic arrangement is provided for activating and deactivating, respectively, the gripping device. A device is provided for moving the gripping means (14) in a longitudinal direction from the sewing plane (4) for obtaining an elastic extension of the fabric from the tip of the stocking having been gripped and a motion of approach to the rotating sewing plane to obtain the rectilinear motion of return in the initial position having allowed the gripping of the stocking: structure is also provided for synchronizing the actions of the gripping device of the stocking with those of the above-mentioned plate of the sewing machine.

11 Claims, 5 Drawing Sheets

METHOD FOR VARYING THE CURVATURE OF THE SEWN TIP OF STOCKINGS WITH A SEWING MACHINE AND DEVICE FOR CARRYING OUT SAID METHOD

FIELD OF THE INVENTION

The present invention pertains to a method for varying the curvature of the sewn tip of stockings with a sewing machine and a device for carrying out this method.

BACKGROUND OF THE INVENTION

It is known that sewing machines for stockings and pantyhose comprise a roundabout with several tubular braces having the function of supporting and turning the stockings inside out, in which each tube is provided with two longitudinally sliding fins for transferring the tip of the stocking beyond the end of the tube on a horizontal rotating disk around its vertical axis, in a predetermined position with respect to a cutting machine. Said disk is associated with a suspended plate with alternating vertical motion with the function of holding, during the sewing, the tip of the stocking steady on the underlying rotating disk opposite the needle of the cutting machine. However, such a device of support and blocking of the stocking during the sewing presents the drawback whereby the arc of curvature of the sewing on the part of the sewing machine is directly connected to the radius of the disk and thus the variation of the curvature of the sewn tip is possible only by substituting the disk, which involves a loss of time which is incompatible with the production requirements of stockings or of pantyhose.

SUMMARY AND OBJECTS OF THE INVENTION

The purpose of the present invention is to eliminate this drawback by proposing an operating method and a device which makes it possible to vary, at will, the curvature of the sewn tip without changing the rotating support of the stocking, but with a simple and rapid operation of selection and/or of adjustment of means for stretching the tip.

To this end, it is achieved in accordance with the present invention, by adopting the idea of utilizing an operating method which consists, after the positioning of the tip of the stocking in the sewing position on the relative rotating disk, of gripping the free end of the stocking, in the center or on the sides, outside and beyond the said disk and of elastically stretching towards the sewing machine the central area with respect to the side areas or vice versa the side area with respect to the central area, subsequently of lowering the plate suspended above the disk and blocking the tip of the stocking thus stretched, thus releasing the free end of the stocking and carrying out the sewing for decreasing or increasing, respectively, with respect to the radius of the said disk, the radius of curvature of the sewn tip for the effect of the spontaneous withdrawal of the fabric which concerns the tip and followed by raising of the plate after the sewing.

Also, a device for carrying out the said method in accordance with the present invention comprises:

means for gripping in several points, separately, the free end of the flattened tip of the stocking to be sewn and which projects beyond the rotating sewing plane;

means for activating and deactivating, respectively, the said gripping means of the stocking;

means for communicating to the said means for gripping the stocking a rectilinear motion of departure in the longitudinal direction of the stocking in the direction of removal from the rotating sewing plane to obtain a stretching, that is, an elastic extension of the fabric of the tip of the stocking having been gripped by the gripping means, and respectively, a motion of approach to the rotating sewing plane to obtain the rectilinear motion of return in the initial position of the gripping means of the stocking after having allowed the gripping of the stocking;

means for synchronizing the actions of the gripping means of the stocking with those of the blocking plate of the stocking on the sewing plane.

The advantages obtained thanks to the present invention essentially consist in that it is possible to permanently modify the curvature of the sewn tip, in the sense of increasing or decreasing, respectively, the radius of curvature with respect to that of the rotating sewing plane; that the sense of the arc of curvature, as well as the width of the variation of same, can be easily regulated, within broad limits, by means of selection and regulation of the course of the gripping means of the tip of the stocking without necessitating any substitution of the components of the sewing machine. These and other advantages and characteristics of the present invention shall be better understood by any person skilled in the art by the description below and with the aid of the attached drawings, given as a practical simplification of the invention, but not to be considered as limiting.

DETAILED DESCRIPTION OF THE PREFERRED EMBODIMENT

Figures 1, 1A, 2, 2A, 3, 3A:
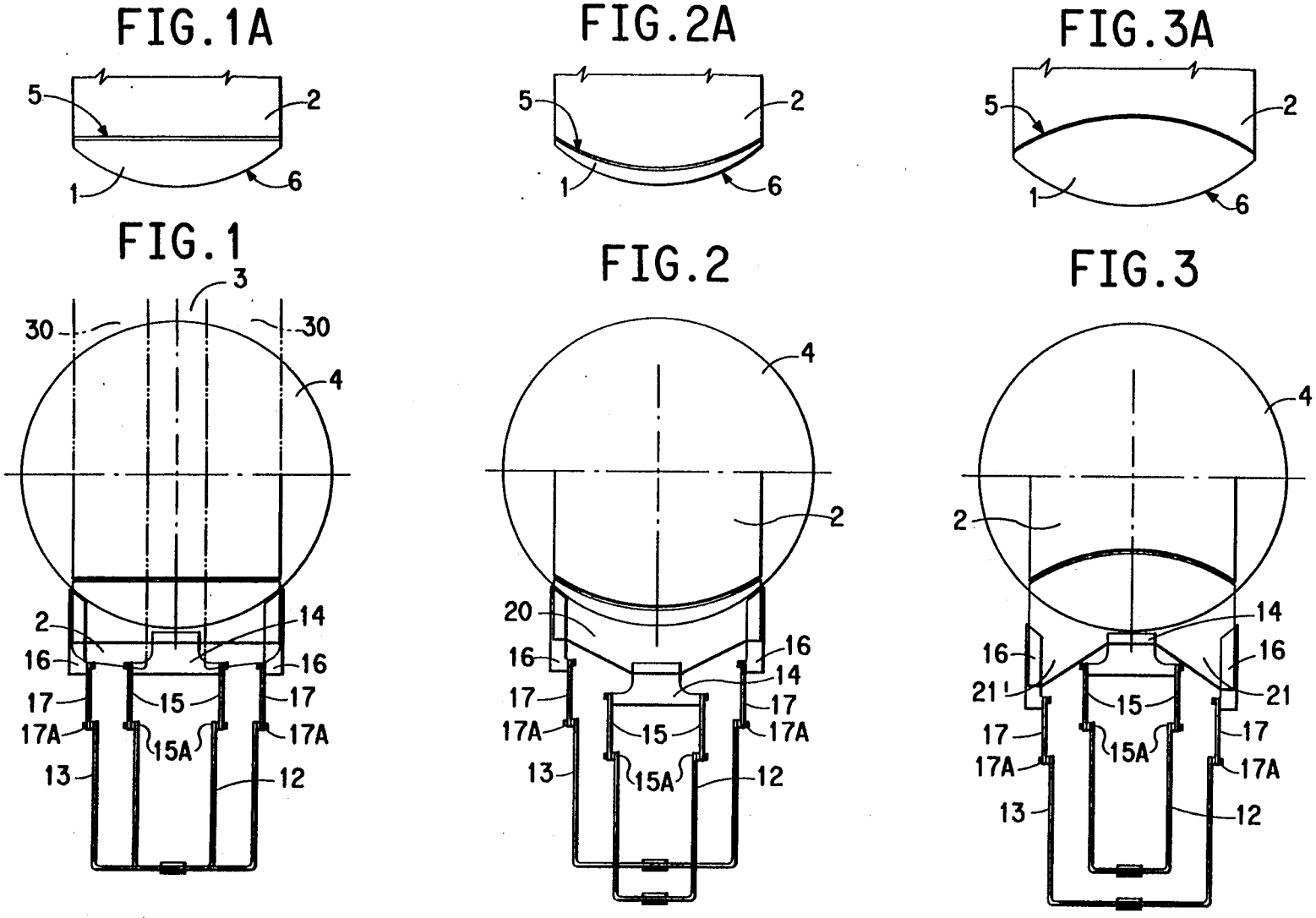
FIG. 1 represents the top schematic view of a device for varying the curvature of the tip of a stocking by means of a sewing machine in accordance with the present invention, in the position to obtain the normal curvature, that is, as in FIG. 1A.
FIG. 2 represents the device of FIG. 1, in the position to obtain a decrease in the curvature, that is, as in FIG. 2A.
FIG. 3 represents the device of FIG. 1, in the position to obtain an increase in the curvature, that is, as in FIG. 3A.
Figure 5:
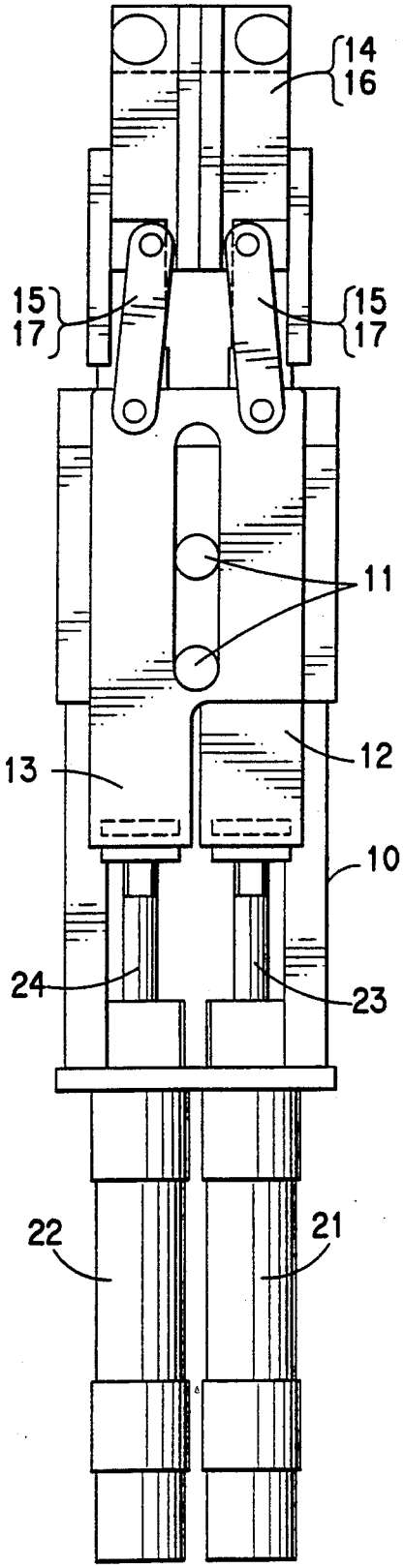
FIG. 5 represents the device of FIG. 4, in the resting position and with the gripping means closed.
Figure 4:
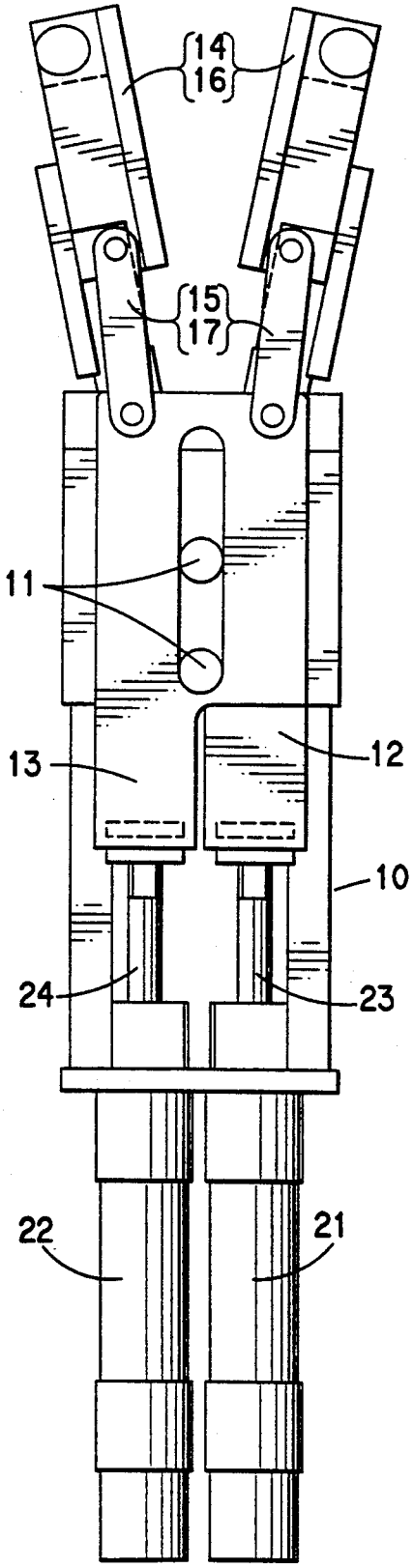
FIG. 4 represents the side view of the device of FIG. 1 in the position with the means for gripping the tip open.
Figure 6:
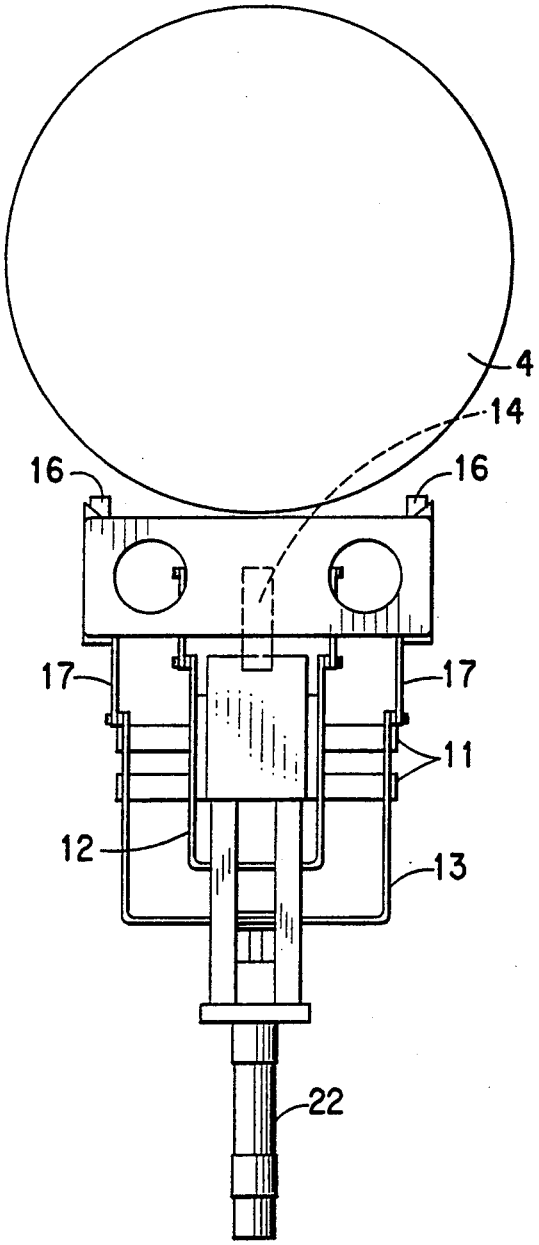
FIG. 6 represents the top view of the device of FIG. 1, with the lateral gripping means withdrawn.
Figure 7:
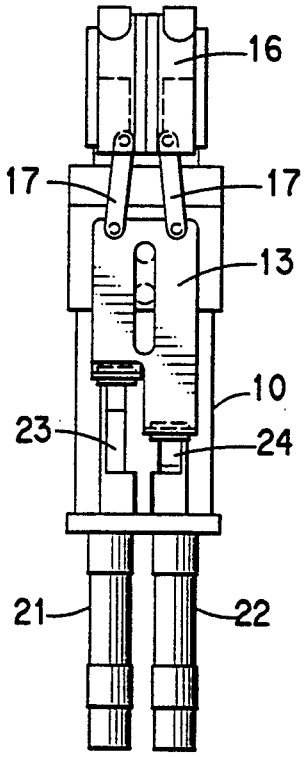
FIG. 7 represents the side view of the device of FIG. 6.
Figure 8:
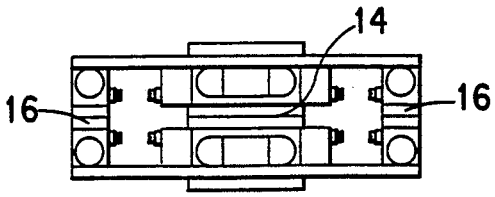
FIG. 8 represents the front view of the device of FIG. 6.
Figure 9:
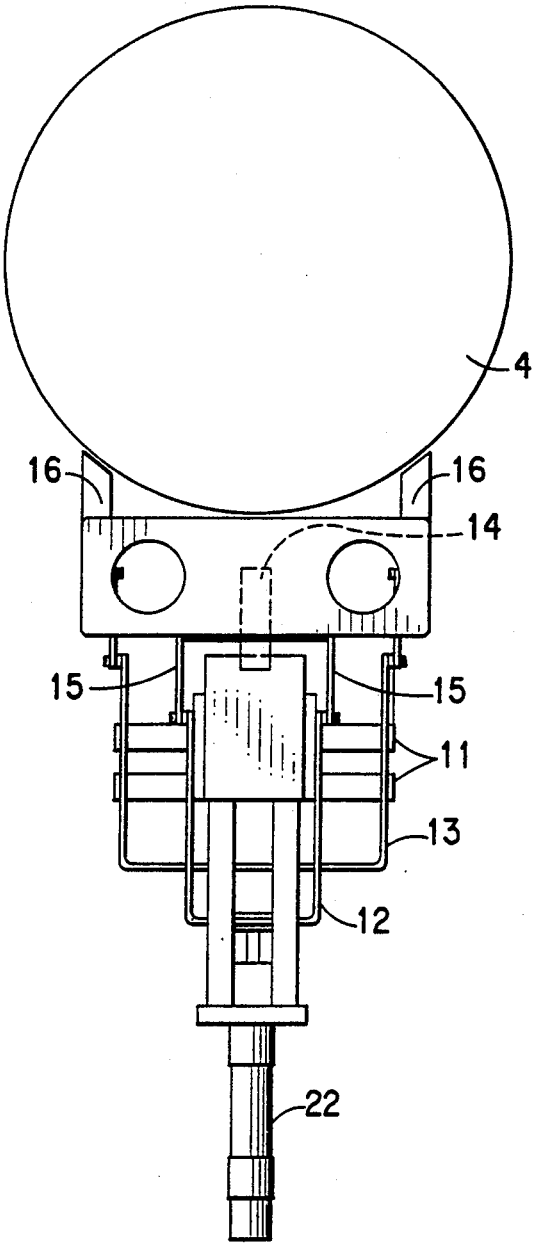
FIG. 9 represents the top view of the device of FIG. 1, with the central gripping means withdrawn.
Figure 10:
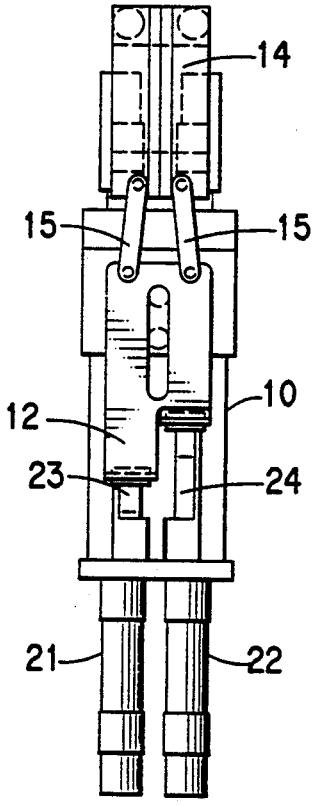
FIG. 10 represents the side view of the device of FIG. 9.
Figure 11:
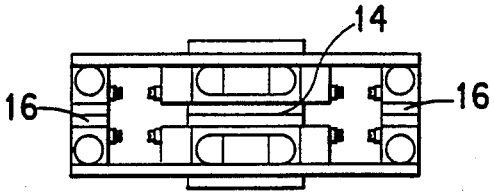
FIG. 11 represents the front view of the device of FIG. 9.

Reduced to its essential structure and with reference to FIGS. 1 to 3 of the attached drawings, the method according to the present invention provides for varying the curvature of the tip 1 of a stocking 2 with respect to that obtainable with the rotating sewing plane of a sewing machine (for stockings or for pantyhose) with at least one sewing position. The stocking is fitted on a pneumatic tipper tube 3 with sliding fins 30 in the area of sewing and after the said fins have transferred the end of the stocking to be sewn beyond the end of the tipper 3 up to above the rotating sewing plane 4, the method provides for:

(a) simultaneously gripping the side portions 21' or respectively the central portion 20 of the end of the stocking 2 to be sewn which projects from the rotating sewing plane 4;

(b) elastically stretching, that is, extending the central portion with respect to the side portions 21' of the stocking 2 or the two side portions 21' with respect to the central portion 20 in such a manner that the central portion 20 surpasses, in the direction of the sewing machine, those side portions 21' or respectively the side portions 21' surpass the central portion 20 according to whether an increase or a decrease, respectively, in the radius of the curvature of the sewn tip must be obtained with respect to that of the rotating sewing plane;

(c) blocking the tip of the stocking 2 thus stretched, that is, elastically extended;

(d) carrying out the sewing of the tip of the stocking thus blocked;

(e) releasing the tip of the stocking thus sewn.

The elastic deformation imparted to the fabric of the tip of the stocking makes it possible, after the elastic return of the sewn tip, to obtain a variation in the final curvature of the seam with respect to that obtained with the rotating sewing plane and the value of which is proportional to the width of the excursion placed on the central area 2 or the two side areas 21, respectively, before the sewing.

The final result is shown in FIGS. 1A to 3A in which the double line 5 represents the beginning of the fabric of the tip and line 6 represents the seam line; more specifically, it is evident from FIG. 1A that no action has been operated on the tip before the sewing so that the seam line 6 obtained is of the traditional type, that is, with a curvature that is determined by the radius of the rotating plane 4 of the seam. From FIG. 2A, it is evident that the stretching of the central portion of the tip of the stocking with respect to the side portions 21' operated before sewing 6 determines, after sewing, a seam line whose curvature has a greater radius compared to that of FIG. 1A.

From FIG. 3A, it is evident that the stretching operated, before sewing, of the side portions 21 with respect to the central portion 20 of the stocking 2 determines, after sewing, a seam line 6 whose curvature has a smaller radius compared to that of FIG. 1A.

With reference to FIGS. 4 to 11 of the attaching drawings, a device for varying the curvature of the sewn tip of stockings is provided for practicing the method in accordance with the present invention. The device includes a pneumatic tipper tube 3 with sliding fins 30 for supporting a stocking 2 and transferring the tip to be sewn above the rotating sewing plane 4 of a sewing machine (not shown), and moreover, the device includes a plate suspended concentrically to the sewing plane and vertically movable with respect to the sewing plane for blocking and rotating the tip of the stocking positioned for sewing. The device further comprises a central fixed body 10 with two complanate transverse pins 11 for supporting and guiding two independent, forked slides 12, 13, one internal 12 and the other external 13, with arms of equal length and with the bases offset between one another to make their alternating, coaxial, horizontal withdrawal possible with respect to the opposite tipper tube which carries the stocking: the pins 11 also performing as a function of the fine running of the slides, respectively, forwards, that is, in the resting position, and backwards, that is, in the position of activation;

a central gripper 14 and two side grippers 16 whose flat ends are articulated at the head of the above-mentioned internal slide 12 and external slide 13, respectively, with the insertion of corresponding connecting rods 15, 17: the pivots of articulation 15A and 17A of the three grippers being aligned with one another when the two slides 12, 13 are completely forward, to make possible the opening and the simultaneous closing, respectively, of the grippers 14 and 16 which are of the type with pincers with pneumatic control;

two pneumatic control cylinders 21, 22, which are parallel and superimposed, arranged in back of the said body 10, and with the stems 23, 24 connected subsequently to the slides 12, 13, respectively, and which are activated by a central unit for withdrawing the slide 13 carrying the two side grippers 16 or the slide 12 carrying the central gripper 14 after the closing of the respective ends: the activation/deactivation of one or both of the cylinders 21, 22 being defined through a special selector connected to the central control unit of the sewing machine in parallel with the control cylinder of the alternating vertical motion of the blocking plate of the tip of the stocking to be sewn in such a manner that the grippers are made to withdraw or to advance, respectively, while the said plate descends or ascends, respectively.

Figure 14:
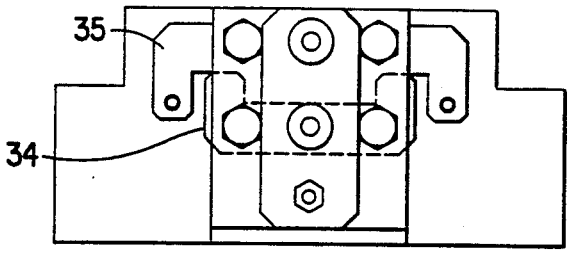
FIG. 14 represents the rear view of the device of FIG. 11.
Figure 13:
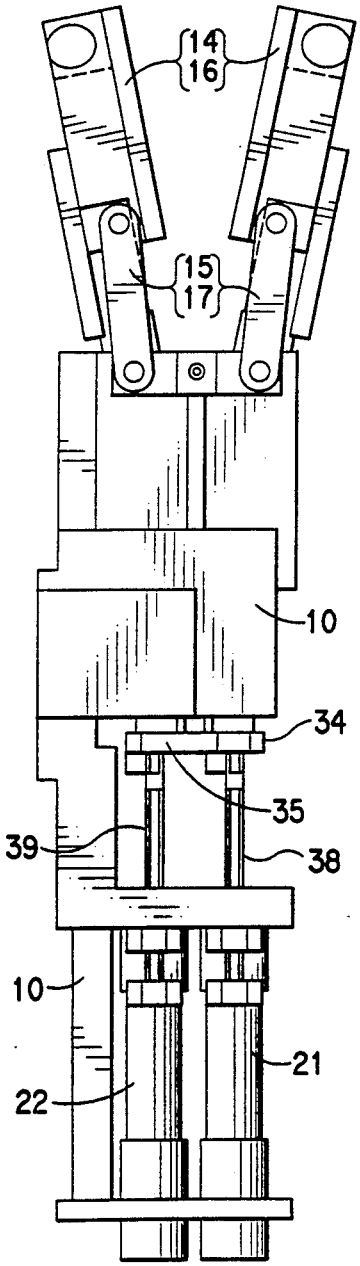
FIG. 13 represents the side view of the device of FIG. 11.
Figure 12:
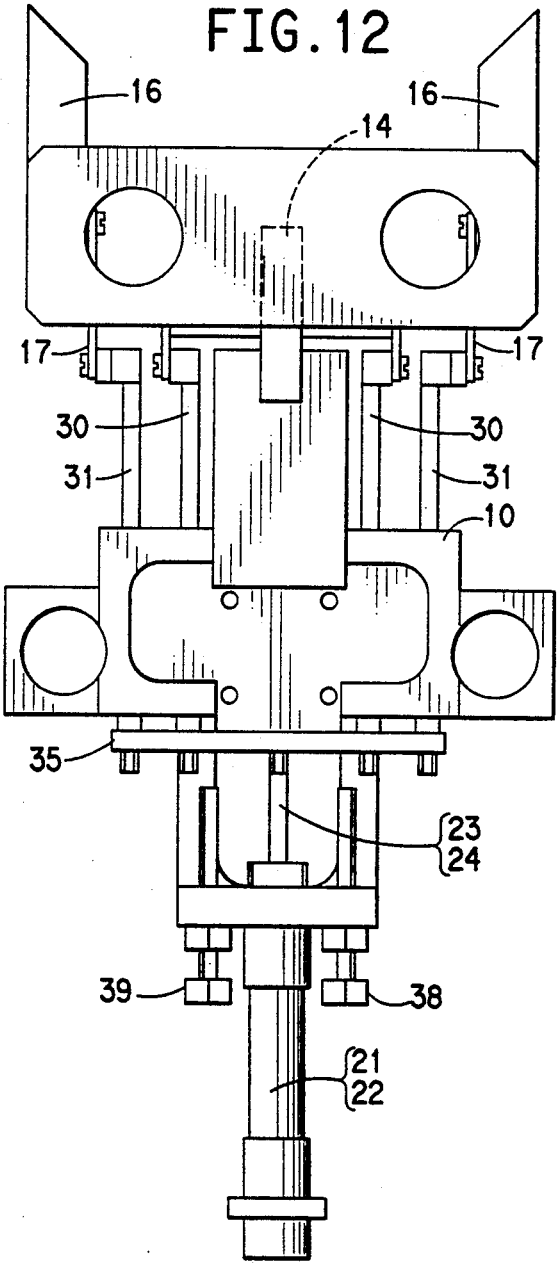
FIG. 12 represents the top view of a variant of the device of FIG. 1 in accordance with the present invention, in the resting position, and with the means for gripping the tip open.

With reference to FIGS. 12 to 14 of the attaching drawings, in accordance with the present invention, one may substitute the slides 12, 13 carrying the grippers 14, 16 with two corresponding pairs of complanate horizontal rods 30, 31 installed sliding in corresponding holes of the body 10 at one end of which are articulated the above-mentioned connecting rods 15, 17, respectively, of the grippers 14, 16, wherein the other end is arranged at a corresponding C-shaped plate 34, 35, with 34 of less width so as to be inside 35. The stems 23, 24 of the above-mentioned control cylinders 21, 22 of the movement of the rods 30, 31 being fixed at the center of the corresponding plates 34, 35 and two pairs of screws 38, 39, displaced bilaterally to the stem 23, 24 of the corresponding cylinder 21, 22, being provided for making it possible to regulate the stopping point of the plates 34, 35 in the course of withdrawal of the grippers 14, 16 and when varying the elastic stretching of the fabric of the tip of the stocking, and consequently varying the radius of curvature of the seam of the tip.

The method functions as follows. At the beginning of the cycle, the grippers 14, 16 are open and in the advanced position, that is, drawn closer (to the maximum), to the sewing plane, and the stocking is on the tipper tube with the tip to be sewn projecting from this tipper tube to the region of action of the fins of the tipper. These fins are in the extended position in such a manner that the tip of the stocking is on the sewing plane of the sewing machine and with the free end of the stocking in the open mouth of the three grippers 14, 16. Subsequently, in relation to the desired curvature of the tip sewn, the closing of the central gripper 14 or of the external gripper 16 is actuated, and the corresponding cylinder 21 or 22 is subsequently activated in such a manner as to obtain the withdrawal of the central gripper or of the lateral grippers. This results in the elastic stretching of the central part or of the side parts, respectively, of the tip of the stocking. With the fine running of the gripper(s), the plate which is suspended above the rotating sewing plane is activated which descends and blocks the tip of the stocking thus stretched on the underlying sewing plane. After the gripper or grippers which have operated the stretching of the stocking are deactivated, that is, open, and sewing is carried out in the traditional manner, that is, rotating in front of the needle of the sewing plane, the rotating sewing plane and the plate with the stocking inserted. When the sewing is completed, the plate is deactivated as the sewn stocking freely ascends; at the same time, the cylinder 21 or 22, which is found in the order of maximum withdrawal of the gripper(s), is activated in such a manner as to bring back the already open gripper(s) into the beginning cycle position.

In practice, the details of execution can, however, vary in an equivalent manner in the shape, dimensions, arrangement of the components, and type of materials used without, moreover, going beyond the scope of the solution idea adopted and therefore remaining within the limits of the protection granted by the present patent for industrial invention.

What is claimed is:

1. Method for varying the curvature of the sewn tip of stockings utilizing means for supporting the stocking and for positioning the tip in a flattened order on a circular, rotating sewing plane in correspondence with the sewing position, the method comprising the steps of:

(a) gripping a free end of the stocking, in a center of the stocking, outside and beyond said rotating sewing plane;

(b) elastically stretching, in the longitudinal direction of the stocking, a central area of the flattened tip of the stocking thus gripped with respect to a side area thereof to obtain a curvilinear seam with a radius greater than the radius of the rotating sewing plane;

(c) arranging the flattened tip of the stocking thus elastically stretched on the rotating sewing plane;

(d) releasing the free end of the tip of the stocking thus arranged;

(e) carrying out the sewing, progressively rotating the sewing plane and at the same time cutting the excess fabric with respect to a seam line;

(f) releasing the tip of the stocking thus sewn.

2. Method according to claim 1, wherein said elastic stretching is adjustable as a function of elastic extension placed on the tip of the stocking.

3. Device for varying the curvature of the tip of stockings, the device comprising:

a horizontal, circular rotating plane, and a plate arranged coaxially therewith;

gripping means for separately gripping several points of a free end of a flattened tip of the stocking to be sewn, said free end projecting beyond the rotating sewing plane;

pneumatic means for activating or deactivating, respectively, said gripping means;

transmission means for transmitting to said gripping means a rectilinear motion of departure in a longitudinal direction of the stocking in a direction of removal from the sewing plane to obtain a stretching by elastic extension of the fabric of the tip of the stocking which has been gripped by the gripping means, and respectively, a motion of approach to the rotating sewing plane to obtain a rectilinear motion of return of said gripping means to an initial position, after having allowed the gripping of the stocking;

means for synchronizing the actions of said gripping means with said plate.

4. Device according to claim 3, wherein said gripping means includes a gripper with flat ends and a pair of grippers with flat ends with an opening with pincers and pneumatic control means in a front portion in a central area, and respectively, in two external areas of a free end of the flattened tip of the stocking: the ends of said gripper and said pair of grippers being articulated at the head of corresponding slide means with horizontal motion alternating with the insertion of two respective connecting rods.

5. Device according to claim 3, wherein said pneumatic means includes two pneumatic cylinders with double effect with stems connected to the back part of a corresponding slide and which pneumatic cylinders are activated separately by a central unit of the sewing machine for activating a central gripper or a pair of external grippers, respectively.

6. Device according to claim 3, wherein said pneumatic means comprises pneumatic cylinders for movement of grippers, said pneumatic cylinders being activated by means of a selector connected in parallel on a control of each pneumatic cylinder for controlling a blocking plate of the tip of the stocking on the rotating sewing plane.

7. Device according to claim 4 wherein said slide means of the grippers comprise U-shaped plates, one internal and one external, with braces of equal length and with the respective bases offset for anchoring a stem of the corresponding control cylinder.

8. Device according to claim 4 wherein said pneumatic means further comprises two pairs of complanate rods at a head of which are articulated said connecting rods and whose base is anchored to a relative control cylinder via a corresponding plate.

9. Device according to claim 8 further comprising: two pairs of screws mounted bilaterally with respect to the control cylinders and producing a base with said plate for regulating withdrawal of the grippers.

10. Method for varying the curvature of the sewn tip of stockings utilizing means for supporting the stocking and for positioning the tip in a flattened order on a circular, rotating sewing plane in correspondence with the sewing position, the method comprising the steps of:

(a) gripping a free end of the stocking at two side areas thereof, with respect to a center of the stocking, outside and beyond said rotating sewing plane;

(b) elastically stretching, in the longitudinal direction of the stocking, the two side areas with respect to the central area to obtain a curvilinear seam with a radius less than the radius of the rotating sewing plane;

(c) arranging the flattened tip of the stocking elastically stretched on the rotating sewing plane;

(d) releasing the free end of the tip of the stocking thus arranged;

(e) carrying out the sewing, progressively rotating the sewing plane and at the same time cutting the excess fabric with respect to a seam line; and (f) releasing the tip of the stocking sewn.

11. A method according to claim 10, wherein said elastic stretching is adjustable as a function of elastic extension imposed on the tip of the stocking.

* * * * *